US006470858B1

(12) United States Patent
Mattes

(10) Patent No.: US 6,470,858 B1
(45) Date of Patent: Oct. 29, 2002

(54) COMMON RAIL INJECTOR

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/856,316

(22) PCT Filed: Aug. 19, 2000

(86) PCT No.: PCT/DE00/02847

§ 371 (c)(1),
(2), (4) Date: Sep. 5, 2001

(87) PCT Pub. No.: WO01/21954

PCT Pub. Date: Mar. 29, 2001

(30) Foreign Application Priority Data

Sep. 22, 1999 (DE) ..... 199 45 314

(51) Int. Cl.[7] ..... F02M 37/04
(52) U.S. Cl. ..... 123/467; 239/96
(58) Field of Search ..... 123/467, 506; 239/88–96

(56) References Cited

U.S. PATENT DOCUMENTS 6,168,132 B1 * 1/2001 Frank et al. ..... 123/467
6,244,245 B1 * 6/2001 Boecking ..... 123/467
6,328,017 B1 * 12/2001 Heinz et al. ..... 123/467
6,336,595 B1 * 1/2002 Barbier ..... 239/96
2001/0050316 A1 * 12/2001 Heinz et al. ..... 239/96
2002/0008156 A1 * 1/2002 Ganser ..... 239/88

FOREIGN PATENT DOCUMENTS

| | | |
|---|---|---|
| DE | 196 34 105 A1 | 1/1998 |
| DE | 198 34 867 A1 | 2/1999 |
| EP | 0 661 442 A1 | 7/1995 |
| EP | 0 916 842 A1 | 5/1999 |

* cited by examiner

*Primary Examiner*—Thomas N. Moulis
(74) *Attorney, Agent, or Firm*—Ronald E. Greigg

(57) ABSTRACT

A common rail injector, having a nozzle body that is secured with the aid of a lock nut to a retaining body having a fuel inlet, which communicates with a central high-pressure fuel reservoir outside the injector and with a pressure chamber inside the injector. From the pressure chamber, as a function of the position of a control valve, fuel subjected to high pressure is injected. The control valve assures that a nozzle needle, which can reciprocate in a longitudinal bore of the injector axially counter to the prestressing force of a nozzle spring that is received in a nozzle spring chamber, lifts from a seat when the pressure in the pressure chamber is greater than the pressure in a control chamber that communicates with the fuel inlet via an inlet throttle. To make higher nozzle needle speeds possible, the control chamber is integrated with the nozzle body. In addition, a control peg, which is guided in the control chamber, is embodied on the end of the nozzle needle remote from the combustion chamber, and the nozzle spring chamber is disposed outside the control chamber.

20 Claims, 1 Drawing Sheet

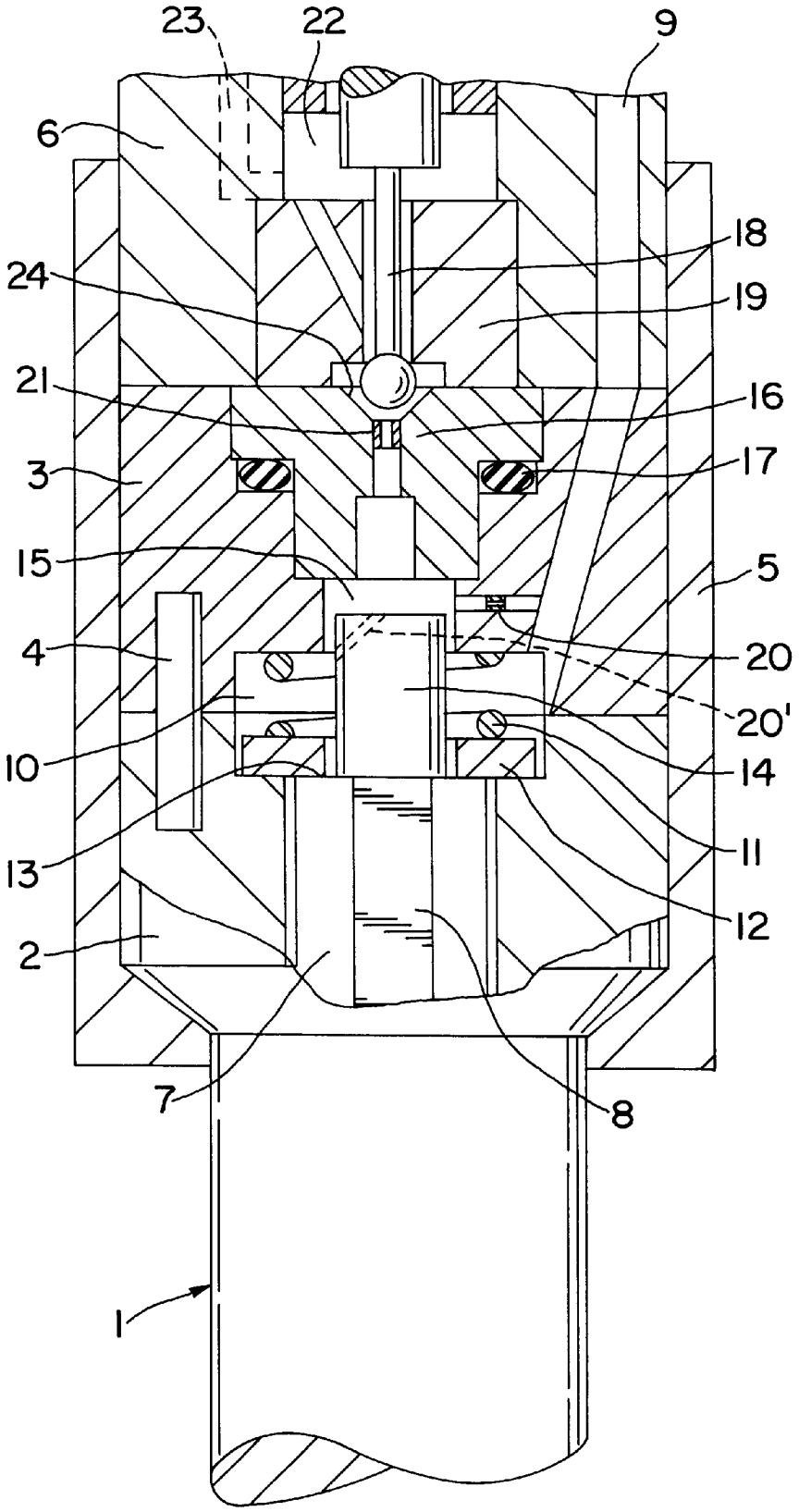
23
22
9
6
18
24
19
21
16
3
17
15
5
4
20
20'
10
14
11
13
12
2
7
8
1

COMMON RAIL INJECTOR

CROSS-REFERENCE TO RELATED APPLICATIONS

This application is a 35 USC 371 application of PCT/DE 00/02847 filed on Aug. 19, 2000.

BACKGROUND OF THE INVENTION

1. Field of the Invention

The invention relates to a common rail injector for injecting fuel in a common rail injection system of an internal combustion engine, having a nozzle body which is secured with the aid of a lock nut on a retaining body that has a fuel inlet in communication with a central high-pressure fuel reservoir outside the injector and with a pressure chamber inside the injector, from which chamber fuel subjected to high pressure is injected as a function of the position of a control valve that assures that a nozzle needle, which can reciprocate in a longitudinal bore of the injector axially counter to the prestressing force of a nozzle spring received in a nozzle spring chamber, lifts from a seat when the pressure in the pressure chamber is greater than the pressure in a control chamber that communicates with the fuel inlet via an inlet throttle.

DESCRIPTION OF THE PRIOR ART

In common rail injection systems, a high-pressure fuel pump feeds the fuel into the central high-pressure reservoir, which is called a common rail. From the common rail, high-pressure lines lead to the individual injectors, which are assigned one to each of the engine cylinders. The injectors are triggered individually by the engine electronics. The rail pressure prevails in the pressure chamber and at the control valve. When the control valve opens, fuel subjected to high pressure enters the combustion chamber, moving past the nozzle needle, which is lifted counter to the prestressing force of the nozzle spring.

In conventional injectors, of the kind known for instance from German Patent Disclosure DE 197 24 637 A1, relatively long nozzle needles with a so-called thrust rod are used. In operation, as a consequence of the high pressures and the rapid load changes, very strong forces are exerted on the nozzle needles. As a result of these forces, the nozzle needle is stretched and compressed in the longitudinal direction. This in turn means that the nozzle needle stroke varies as a function of the forces acting on the nozzle needle.

In German Patent Disclosure DE 199 36 668, not published by the priority date of the present application, injectors are described that work without a thrust rod. To define the control chamber, a sleeve is used that is displaceable, performing sealing, on the end of the nozzle needle remote from the combustion chamber and that is retained in contact with the injector housing with the aid of the nozzle spring. Sealing off of the control chamber is achieved by a bite edge embodied on the bearing face of the sleeve. If a leak occurs at the bite edge, this can cause failure of the affected injector.

OBJECTS AND SUMMARY OF THE INVENTION

The primary object of the invention is to furnish a common rail injector that while using conventional injection nozzles permits markedly higher nozzle needle speeds and that functions stably. Furthermore, the injector of the invention should be simple in design and capable of being economically produced.

In a common rail injector for injecting fuel in a common rail injection system of an internal combustion engine, having a nozzle body, which is secured with the aid of a lock nut on a retaining body that has a fuel inlet in communication with a central high-pressure fuel reservoir outside the injector and with a pressure chamber inside the injector, from which chamber fuel subjected to high pressure is injected as a function of the position of a control valve which assures that a nozzle needle, which can reciprocate in a longitudinal bore of the injector axially counter to the prestressing force of a nozzle spring that is received in a nozzle spring chamber, lifts from a seat when the pressure in the pressure chamber is greater than the pressure in a control chamber which communicates with the fuel inlet via an inlet throttle, this object is attained in that the control chamber is integrated with the nozzle body; that embodied on the end of the nozzle needle remote from the combustion chamber is a control peg which is guided in the control chamber, and that the nozzle spring chamber is disposed outside the control chamber. The invention offers the advantage that the control chamber and the nozzle spring chamber can be disposed on the end of the nozzle needle remote from the combustion chamber, yet the volume of the control chamber does not depend on the installation space for the nozzle spring. It is therefore possible to build in a large-volume nozzle spring with high spring rigidity, which assures good closure of the nozzle needle. As a result, the injection time and the instant of injection can be defined exactly.

A particular feature of the invention is characterized in that the fuel inlet discharges into the nozzle spring chamber, and that at least one flat face is embodied at the nozzle needle between the nozzle spring chamber and the pressure chamber. This creates a fluidic communication between the nozzle spring chamber and the pressure chamber, through which the fuel to be injected can travel from the fuel inlet into the pressure chamber. The bore to the pressure chamber that is present in conventional injectors can be omitted.

Another particular feature of the invention is characterized in that the nozzle body is embodied in two parts, and that the control chamber is embodied in the part of the nozzle body remote from the combustion chamber. In the production of the nozzle body, a lengthened nozzle body is required. Before the part remote from the combustion chamber is cut off, a central bore for the needle and two fixation bores for receiving a fixation pin in the assembled state are advantageously made in the nozzle body. As a result, a lateral offset of the needle bore and guide bore and thus an overdetermined needle guidance are avoided.

A further particular feature of the invention is characterized in that a valve piece, which has a central run-up bore with an outlet throttle and a valve seat, is disposed in the part of the nozzle body remote from the combustion chamber. The central run-up bore creates communication between the control chamber and a relief chamber. The valve seat cooperates with a control valve member that controls the injection course of the injector of the invention. Because the outlet throttle is integrated with the valve piece, easy replacement of the outlet throttle is assured.

A further particular feature of the invention is characterized in that the inlet throttle is provided in a bore is in the nozzle body, which bore connects the control chamber with the nozzle spring chamber. For production and/or cost reasons, the inlet throttle can also be provided in some other component, such as the nozzle needle.

A further particular feature of the invention is characterized in that a shoulder, which forms a stop for a shim that acts as an abutment for the nozzle spring, is embodied on the nozzle needle. By a suitable choice of the thickness of the shim, the initial tension and the stroke of the nozzle needle can be adjusted.

BRIEF DESCRIPTION OF THE DRAWING

Further advantages, characteristics and details of the invention will become apparent from the ensuing description, taken in conjunction with the single drawing figure showing a fragmentary sectional view of the injector of the invention.

DESCRIPTION OF THE PREFERRED EMBODIMENT

In FIG. 1, a detail of a common rail injector of the invention is shown in longitudinal section. The injector shown includes a nozzle body 1. With its free end (not shown), the nozzle body 1 protrudes into the combustion chamber of the internal combustion engine to be supplied. The nozzle body 1 is formed by one part 2 near the combustion chamber and one part 3 remote from the combustion chamber. The part 2 near the combustion chamber and the part 3 remote from the combustion chamber are in contact with one another and are kept in position relative to one another, in the assembled state, by a fixation pin 4.

With the aid of a lock nut 5, the nozzle body 1 is braced against a retaining body 6. A nozzle needle 7 is received axially displaceably in the nozzle body 1. A plurality of flat faces 8, only one of which is visible in the drawing, are embodied on the outer circumferential face of the nozzle needle 7. The flat faces 8 create a communication between a fuel inlet 9, which extends through the retaining body 6 and the part 3 of the nozzle body 1 remote from the combustion chamber into a nozzle spring chamber 10, and a pressure chamber (not shown).

A nozzle spring 11 is received in the nozzle spring chamber 10 and keeps the tip of the nozzle needle 7 in contact with an associated seat (not shown). The nozzle spring 11 is prestressed between an end face, toward the combustion chamber, of the part 3 of the nozzle body 1 remote from the combustion chamber and a shim 12. The shim 12 rests on a shoulder 13, which is formed on the nozzle needle 7.

Adjoining the shoulder 13 on the end of the nozzle needle 7 remote from the combustion chamber, a control peg 14 is embodied, with a lesser diameter than the nozzle needle 7. The control peg 14 is guided in a control chamber 15 that is formed by a central bore in the part 3 of the nozzle body 1 remote from the combustion chamber. The nozzle spring 11 is disposed outside the control chamber 15, concentrically with the control peg 14.

The central bore in the part 3 of the nozzle body 1 remote from the combustion chamber has three portions of 20 different diameters. The control chamber 15 is disposed in the portion having the smallest diameter.

On the side remote from the combustion chamber, the control chamber 15 is defined by a valve piece 16. A sealing ring 17 of copper or steel is disposed between a collar, embodied on the valve piece 16, and a shoulder extending all the way around the part 3 of the nozzle body 1 remote from the combustion chamber. The sealing ring 17 assures the sealing off of the control chamber 15 on the side remote from the combustion chamber.

Via an inlet throttle 20, which is embodied in the part 3 of the nozzle body 1 remote from the combustion chamber, fuel subjected to high pressure from the fuel inlet 9 reaches the control chamber 15. The control chamber 15 communicates with a relief chamber 22, via an outlet throttle 21 that is embodied centrally in the valve piece 16. Alternatively, as shown in dashed lines in the figure, the inlet throttle 20 can be replaced by an inlet throttle 20' shown within the nozzle needle.

Adjoining the outlet throttle 21, a funnel-shaped valve seat 24 is embodied on the valve piece 16. The valve seat 24 cooperates with a control valve member 18 that is received 115 reciprocatably in a valve body 19. Depending on whether a ball, embodied on the end of the control valve member 18 toward the combustion chamber, is in contact with the valve seat 24, a communication between the control chamber 15 and the relief chamber 22 is opened. The relief chamber 22 communicates with a fuel tank (not shown) via a fuel outlet 23.

If no injection is taking place, the nozzle needle 7 is pressed against its seat by the rail pressure. The total of the control chamber closing force and the nozzle spring closing force predominates over the seat force at the needle seat. The injection is initiated by the pressure relief of the control chamber 15. The nozzle needle 7 lifts from its seat, and fuel subjected to high pressure is injected through injection ports (not shown) into the combustion chamber of the engine. The opening and closing speeds are determined, given a fixed ratio between the outlet and the inlet, by the cross section of the control peg 14.

Because of the functional principle according to the invention, no internal leakage occurs in the injector shown. Hence in the unactuated state, no leaking oil is carried away, making for lower specific consumption values. In addition, because of the defined sealing off of the control chamber 15, increased functional safety of the injector of the invention is assured. The injector tolerances are reduced compared with conventional injectors. Furthermore, the provisions according to the invention make it possible to produce injectors with smaller dimensions than conventional injectors. The outlet throttle is separate from the inlet throttle.

The control valve 16,18, 19 can be embodied as a single-switching or double-switching valve. As an actuator, a magnet or a piezoelectric actuator can be used.

The foregoing relates to preferred exemplary embodiments of the invention, it being understood that other variants and embodiments thereof are possible within the spirit and scope of the invention, the latter being defined by the appended claims.

What is claimed is:

1. In a common rail injector for injecting fuel in a common rail injection system of an internal combustion engine, having a nozzle body (1), which is secured with the aid of a lock nut (5) on a retaining body (6) that has a fuel inlet (9) in communication with a central high-pressure fuel reservoir outside the injector and with a pressure chamber inside the injector, from which pressure chamber fuel subjected to high pressure is injected as a function of the position of a control valve (16, 18) which assures that a nozzle needle (7), which can reciprocate in a longitudinal bore of the injector axially counter to the prestressing force of a nozzle spring (11) that is received in a nozzle spring chamber (10), lifts from a seat when the pressure in the pressure chamber is greater than the pressure in a control chamber (15) that communicates with the fuel inlet (9) via an inlet throttle (20), the improvement wherein the control chamber (15) is integrated with the nozzle body (1); that on the end of the nozzle needle (7) remote from the combustion chamber, a control peg (14) is embodied which is guided in the control chamber (15), and that the nozzle spring chamber (10) is disposed outside the control chamber (15).

2. The common rail injector of claim 1, wherein the fuel inlet (9) discharges into the nozzle spring chamber (10), and that at least one flat face (8) is embodied at the nozzle needle (7) between the nozzle spring chamber (10) and the pressure chamber.

3. The common rail injector of claim 1, wherein the nozzle body (1) is embodied in two parts (2, 3), and that the control chamber (15) is embodied in the part (3) of the nozzle body (1) remote from the combustion chamber.

4. The common rail injector of claim 3, wherein a valve piece (16), which has a central run-up bore with an outlet throttle (21) and a valve seat (24), is disposed in the part (3) of the nozzle body (1) remote from the combustion chamber.

5. The common rail injector of claim 1, wherein the inlet throttle (20) is provided in a bore in the nozzle body (1), which bore connects the control chamber (15) with the nozzle spring chamber (10).

6. The common rail injector of claim 1, wherein the inlet throttle is integrated with the nozzle needle.

7. The common rail injector of claim 1, wherein a step (13), which forms a stop for a shim (12) that acts as an abutment for the nozzle spring (11), is embodied on the nozzle needle (7).

8. The common rail injector of claim 2, wherein the nozzle body (1) is embodied in two parts (2, 3), and that the control chamber (15) is embodied in the part (3) of the nozzle body (1) remote from the combustion chamber.

9. The common rail injector of claim 8, wherein a valve piece (16), which has a central run-up bore with an outlet throttle (21) and a valve seat (24), is disposed in the part (3) of the nozzle body (1) remote from the combustion chamber.

10. The common rail injector of claim 2, wherein the inlet throttle (20) is provided in a bore in the nozzle body (1), which bore connects the control chamber (15) with the nozzle spring chamber (10).

11. The common rail injector of claim 3, wherein the inlet throttle (20) is provided in a bore in the nozzle body (1), which bore connects the control chamber (15) with the nozzle spring chamber (10).

12. The common rail injector of claim 4, wherein the inlet throttle (20) is provided in a bore in the nozzle body (1), which bore connects the control chamber (15) with the nozzle spring chamber (10).

13. The common rail injector of claim 8, wherein the inlet throttle (20) is provided in a bore in the nozzle body (1), which bore connects the control chamber (15) with the nozzle spring chamber (10).

14. The common rail injector of claim 9, wherein the inlet throttle (20) is provided in a bore in the nozzle body (1), which bore connects the control chamber (15) with the nozzle spring chamber (10).

15. The common rail injector of claim 2, wherein the inlet throttle is integrated with the nozzle needle.

16. The common rail injector of claim 3, wherein the inlet throttle is integrated with the nozzle needle.

17. The common rail injector of claim 4, wherein the inlet throttle is integrated with the nozzle needle.

18. The common rail injector of claim 8, wherein the inlet throttle is integrated with the nozzle needle.

19. The common rail injector of claim 2, wherein a step (13), which forms a stop for a shim (12) that acts as an abutment for the nozzle spring (11), is embodied on the nozzle needle (7).

20. The common rail injector of claim 8, wherein a step (13), which forms a stop for a shim (12) that acts as an abutment for the nozzle spring (11), is embodied on the nozzle needle (7).

* * * * *